United States Patent [19]

Tallman

[11] Patent Number: 4,984,337

[45] Date of Patent: Jan. 15, 1991

[54] ANTI-SLIP LOCKING DEVICE

[76] Inventor: Jeff K. Tallman, 14 Trout Brook La., Weston, Conn. 06883

[21] Appl. No.: 513,118

[22] Filed: Apr. 23, 1990

[51] Int. Cl.[5] ..... B65D 63/00

[52] U.S. Cl. ..... 24/16 R; 24/17 AP; 24/16 PB

[58] Field of Search ..... 24/16 R, 16 PB, 17 AP, 24/30.5 P, 30.5 W, 300, 134 L

[56] References Cited

U.S. PATENT DOCUMENTS

| | | | |
|---|---|---|---|
| 666,960 | 1/1901 | Fuller et al. | 24/16 R |
| 3,475,716 | 10/1969 | Laig | 24/16 PB |
| 3,654,668 | 4/1972 | Appleton | 24/16 R |
| 4,558,495 | 12/1985 | Olsen | 24/16 PB |

*Primary Examiner*—Victor N. Sakran

[57] ABSTRACT

An anti-slip locking device employs an elongated member having first and second opposite ends and an external surface extending between its ends. The member has a bore extending between its ends in the direction of elongation and a least one slot in its outer surface which extends between the ends of the member and is parallel to the bore. The slot has a first cross-sectional area. An elastic cord has first and second opposite ends and has a second cross-sectional area which is larger than said first area when the cord is free of tension. The cord has a third cross-sectional area smaller than the first area when the cord is subjected to tension. The third area decreases in size as the tension increases. The cord extends slidably through the bore with its first end disposed outside of the member adjacent the first member end. The second end of the cord is disposed outside of the member adjacent the second member end and forms a loop adjustable in size. The loop is adapted to receive an end of an electric power cable whereby the loop can be reduced in size by pulling the first end of the cord away from the first member end until the cable end is held firmly within the loop. An element is removably disposable in the bore at the first member end to hold the cord in the position in which it is placed when the article is held firmly within the loop thereby preventing slippage of the cord. A portion of the cord between the means and the first cord end adjacent the means is aligned with the slot whereby when the this portion is subjected to a force of tension, the portion can be fitted into the slot and thereafter locked removably in position by removing the force.

8 Claims, 1 Drawing Sheet

ANTI-SLIP LOCKING DEVICE

BACKGROUND OF THE INVENTION

When portable electrical power tools having relatively long lengths of power cable, such as portable electric drills and the like, are to be stored for subsequent use, it is often necessary to wind the cable around the body of the tool and then remove the tool with the cable in wound condition for ease of storage and to prevent the cable from accidentally being entangled or otherwise creating a hazard. Even when the cable is properly coiled and stored, the coils may become unwound accidentally thereafter and become entangled or otherwise produce hazardous conditions.

The present invention is directed toward a new and improved device, termed herein an anti-slip locking device, which is adapted for in protecting the power cord in coiled position in such manner it cannot be accidentally unwound and create hazardous conditions.

SUMMARY OF THE INVENTION

Accordingly, it is an object of the present invention to provide an anti-slip locking device that can be constructed easily and inexpensively.

Another object is to provide an anti-slip locking device that can be easily and quickly installed for use or removed as and when desired.

Yet another object is to provide an anti-slip locking device that is small, readily portable and easily operated manually by any user.

These and other objects and advantages of this invention will either be explained or will become apparent hereinafter.

In accordance with the principles of this invention, an anti-slip locking device employs an elongated member having first and second opposite ends and an external surface extending between its ends. The member has a bore extending between its ends in the direction of elongation. The member also had a least one slot in its outer surface which extends between the ends of the member and is parallel to the bore. The slot has a first cross-sectional area.

The member also employs an elastic cord having first and second opposite ends. The cord has a second cross-sectional area which is larger than said first area when the cord is free of tension. The cord has a third cross-sectional area which is smaller than the first area when the cord is subjected to tension. The third area decreases in size as the tension increases.

When the device is in use, the cord extends slidably through the bore with its first end disposed outside of the member adjacent the first member end. The second end of the cord is disposed outside of the member adjacent the second member end and forms a loop adjustable in size. The loop is adapted to receive and engage the end of the power cable of a portable electric power tool remote from the tool and adjacent the cable male connector. Once this cable end is properly positioned within the loop, the loop is reduced in size and tightened by pulling the first end of the cord away from the first member end until the cable end is held firmly within the loop.

The device also employs means removably disposable in the bore at the first member end to hold the cord in the position in which it is placed when the cable end is held firmly within the loop thereby preventing any loosening of the cable and slippage of the cord.

The cable can be coiled either before or after the loop is tightened.

Therafter, the section of the cord which extends between the means and the first cord end can be wrapped around the cable coils and pulled tight to hold the cable coils in engagement with the external surface of the member and at the same time to align the first cord end and adjacent cord portion with the slot. The adjacent portion is then subjected to a force of tension to reduce its cross-sectional area from the second area which is too large for this portion to fit within the slot to the third area which can fit within the slot. The portion is then fitted into the slot. The tension force is then removed, causing the cross-sectional area to increase and bear against the walls of the slot. This portion is then locked in position and holds the cable coils in locked position.

The cable coils can be released and the cable can be completely released from the device by reversing the steps set forth above.

DETAILED DESCRIPTION OF PREFERRED EMBODIMENT

Figure 7:
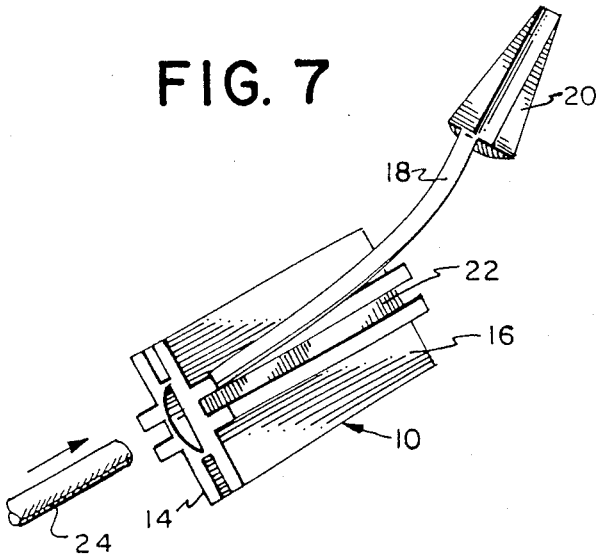
FIG. 7 is a perspective view of the invention prior to use.
Figure 4:
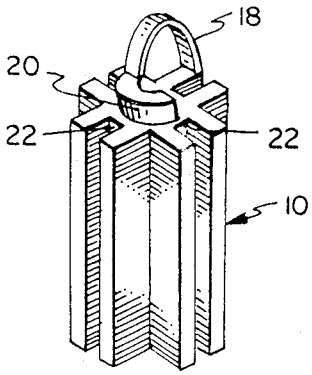
FIG. 4 is a perspective view of the device and wedge shown in FIGS. 2 and 3.
Figure 6:
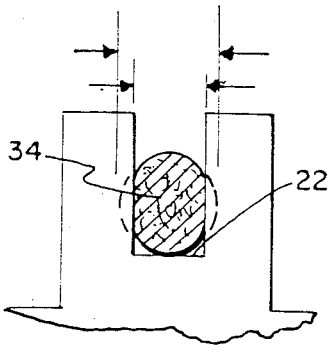
FIG. 6 is a detail view illustrating the positioning of the cord in a slot in the member.
Figure 2:
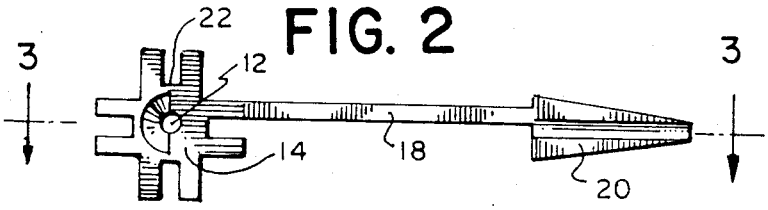
FIG. 2 is an end view of the device and wedge prior to insertion of the elastic cord.
Figure 3:
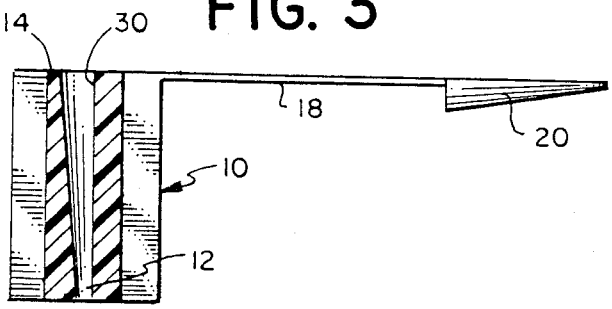
FIG. 3 is a view taken along line 3—3 in FIG. 2.
Figure 1:
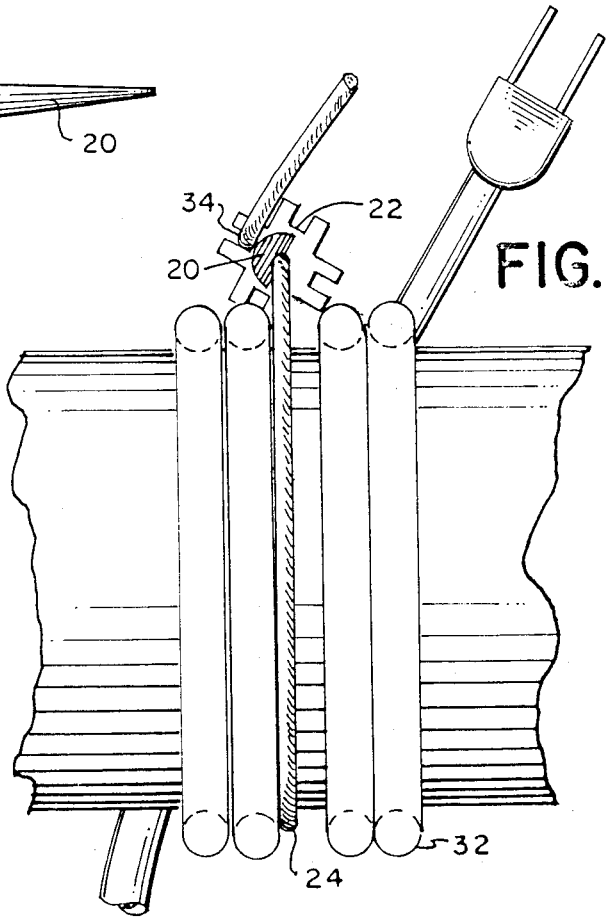
FIG. 1 is a partially cut away view showing the invention in use.
Figure 5:
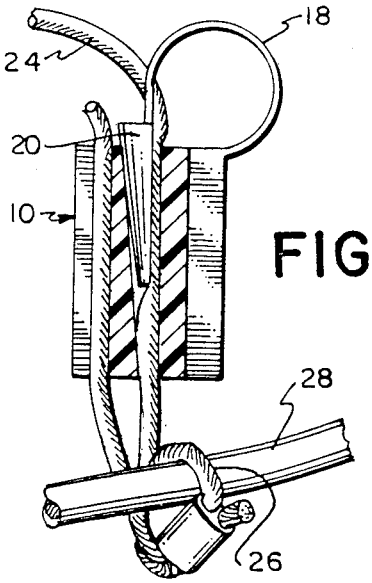
FIG. 5 is a cross sectional view of the member and loop with the wedge in position.

Referring now to FIGS. 1–7, there is shown an elongated plastic member 10 having a central bore 12 extending in the direction of elongation between first and second ends 14 and 16. Integral with member 10 is an elongated plastic ribbon 18 secured at one end to end 14 and at the other end to a plastic wedge 20. Member 10 has an external surface carrying a plurality of slots 22 equidistantly spaced from each other and extending parallel to bore 12.

An elastic cord 24 extends slidably through the bore. One end of the cord disposed outside of the member adjacent end 16 is formed into a loop 26 which is adjustable in size and shape. In use, the end 28 of a power cable of a portable electrically powered tool such as a power drill remote from the handle and adjacent the male connector plug secured to this cable end and adapted to connect the tool to a source of electric power is disposed within the loop and the cord is pulled through the member until the loop is tightened about the end 28 and holds it securely in place. The wedge is then inserted into the end of the bore exposed in end 14 of the member 10.

The portion 30 of the bore which receives the wedge is suitably contoured to match the shape of the wedge whereby with the wedge in position, the cord cannot slide in the bore and the loop cannot be loosened.

The cord when not subjected to tension force has a cross sectional area which is larger than that of the uniform cross-sectional area of any of the slots and the cord cannot be press fitted into any of the slots. However, when the cord is subjected to tension force, it is elongated and its cross-sectional area decreases. When this decrease is sufficiently large, the cross-sectional area of the cord will be sufficiently small to allow the portion of the cord exhibiting the reduced area to be press fitted into a slot. When the tension force is removed or released, the portion of the cord in the slot will attempt to return to its original length, and the increase in cross-sectional area will cause this portion of the cord to bear against the walls of the slot. This portion of the cord will then be locked in position in the slot and can only be released when sufficient tension force is exerted thereon.

The portion of the cord which extends out of end 16 is wrapped around the cable coils 32 to force the coils against the external surface of the member. The end of the cord and its adjacent section 34 is then subjected to tension force and inserted into a slot 22. The force is then removed and the cable coils 32 and cable end 28 are locked in position together as shown.

If desired, the member 10 can be integral with the power cable instead of being a separate unit.

While the invention has been described with particular reference to the detailed description and the drawings, the protection sought is to be limited only by the terms of the claims which follow.

What is claimed is:

1. An anti-slip locking device comprising:

an elongated member having first and second opposite ends and an external surface extending between its ends, the member having a bore extending between its ends in the direction of elongation, said member having at least one slot in its outer surface which extends between the ends of the member and is parallel to the bore, the slot having a first cross-sectional area;

an elastic cord having first and second opposite ends, said cord having a second cross-sectional area larger than said first area when the cord is free of tension and having a third cross-sectional area smaller than the first area when the cord is subjected to tension, the third area decreasing in size as the tension increases, said cord extending slidably through the bore with its first end disposed outside of the member adjacent the first member end, the second end of the cord being disposed outside of the member adjacent the second member end and forming a loop adjustable in size, the loop being adapted to receive an article whereby the loop can be reduced in size by pulling the first end of the cord away from the first member end until the article is held firmly within the loop; and means removably disposable in the bore at the first member end to hold the cord in the position in which it is placed when the article is held firmly within the loop thereby preventing slippage of the cord, a portion of the cord between the means and the first cord end adjacent the means being alignable with the slot whereby when this portion is subjected to a force of tension, the portion can be fitted into the slot and thereafter locked removably in position by removing the force.

2. The device of claim 1 wherein the member has a uniform cross sectional shape and area.

3. The device of claim 2 wherein the member is provided with a plurality of said slots which are spaced from each other.

4. The device of claim 3 wherein said means includes a wedge shaped element.

5. The device of claim 4 wherein said element is connected to the member by an elongated flexible connector.

6. The device of claim 5 wherein the element, connector and member constitute an integral unit.

7. The device of claim 6 wherein that portion of the bore in which the wedge is fitted is shaped to receive the wedge in removable locking engagement.

8. The device of claim 7 wherein the article can be the end of a power cable of a portable electric device adjacent a male connector and when the remainder of the cable is wrapped about the body of the device, the cable coils can be squeezed against the external surface of the body by wrapping a portion of the cord therearound and pulling it tight before locking a section of the cord in a slot.

* * * * *